United States Patent [19]

Reinhardt

[11] Patent Number: 4,768,598

[45] Date of Patent: Sep. 6, 1988

[54] FLUID PRESSURE ACTUATED BYPASS AND PRESSURE INDICATING RELIEF VALVE

[75] Inventor: Paul A. Reinhardt, Houston, Tex.

[73] Assignee: Baker Hughes Incorporated, Houston, Tex.

[21] Appl. No.: 103,306

[22] Filed: Oct. 1, 1987

[51] Int. Cl.[4] ..... E21B 4/02; E21B 21/08; E21B 21/10

[52] U.S. Cl. ..... 175/26; 175/48; 175/107

[58] Field of Search ..... 175/107, 57, 324, 26, 175/40, 48; 60/468; 415/36

[56] References Cited

U.S. PATENT DOCUMENTS

| | | | |
|---|---|---|---|
| 2,865,602 | 12/1958 | Whittle | 175/107 |
| 2,879,032 | 3/1959 | Whittle | 175/26 X |
| 2,963,099 | 12/1960 | Gianelloni, Jr. | 175/107 X |
| 3,802,515 | 4/1974 | Flamand et al. | 175/26 X |
| 3,840,080 | 10/1974 | Berryman | 175/107 |
| 4,275,795 | 6/1981 | Beimgraben et al. | 175/26 |
| 4,280,524 | 7/1981 | Beimgraben | 175/107 X |
| 4,546,836 | 10/1985 | Dennis et al. | 175/107 |

*Primary Examiner*—Stephen J. Novosad

*Attorney, Agent, or Firm*—Hubbard, Thurman, Turner & Tucker

[57] ABSTRACT

A control apparatus preferably for concurrently protecting a downhole fluid pressure operated device from excessive fluid pressures and indicating at the surface when any such excessive fluid pressure level has been reached. The pressured fluid is directed through a bore of a sleeve, and a flow plug is normally located in an axially remote position relative to the sleeve bore. The flow plug is moved upon the occurrence of a predetermined fluid pressure across the downhole device to move into the bore of the sleeve and produce a flow constriction which will result in an detectable fluid pressure signal at the surface. Concurrently, a bypass flow path is established around the fluid pressure operated device to immediately reduce the fluid pressure being applied to such device.

21 Claims, 3 Drawing Sheets

FLUID PRESSURE ACTUATED BYPASS AND PRESSURE INDICATING RELIEF VALVE

BACKGROUND OF THE INVENTION

1. Field of the Invention

The present invention relates to a combination fluid pressure actuated bypass and relief valve which is particularly suited for use in a fluid pressure actuated downhole drilling motor.

2. Description of the Prior Art

Downhole drilling motors of the positive displacement type, embodying a rotor and stator arrangement of the Moineau type illustrated and described in U.S. Pat. No. 1,892,217, are well-known. The rotor in early drilling motors had one lobe operating within a companion two-lobe stator made of rubber or corresponding elastomeric material, the rotor itself being a solid steel member. The rotor partakes of an eccentric or orbital pass around the axis of the stator, producing an excessive amount of vibration as a result of the orbiting speed of the rotor, combined with its relatively high mass due to its solid construction, resulting in a decreased life of the rotor and of the parts of the motor associated therewith.

The drilling weight of prior motor apparatus is transmitted through a bearing assembly being lubricated by the drilling mud or other fluid pumped down through the string of drill pipe and through the motor itself. Since drilling mud is very often sand laden, the bearings are operating in an abrasive liquid, resulting in their relatively short life, limiting the time that the motor can be used in drilling a borehole, with consequent requirements for moving the entire motor appartus from the borehole and replacement of a substantial number of its parts or, for that matter, replacement of the entire motor unit. Because of the use of the solid rotor, a dump valve assembly is incorporated in the drilling string above the motor to allow the drilling fluid to fill the drill pipe as the apparatus is run in the bore hole and to drain from the drill pipe while coming out of the hole.

The use of a single lobe rotor results in the rotor, drive shaft, and bit connected thereto operating at a relatively high speed, the motor being capable of producing a low maximum torque. Such high speed reduces considerably the drilling life of a drill bit, shortens the life of the bearings, and increases the aforementioned vibration difficulties. With a single lobe rotor, only a limited fluid pressure differential can be used to prevent excessive fluid slippage between the rotor and stator during orbital movement of the rotor around the stator axis with consequent reduction in the horsepower developed by the drilling motor.

U.S. Pat. No. 3,840,080 discloses a downhole drilling motor having a multiple lobe rotor operating within a companion multiple lobe stator. In a Moineau type of apparatus, the stator has one lobe more than the rotor.

With a drilling motor embodying a multiple lobe rotor, the pressure differential that can be used without an undesirable percentage of fluid slippage is far greater than with a single lobe rotor. Accordingly, for a given pressure differential, more drilling weight can be applied to the drilling bit, or conversely, a given drilling weight can be applied to the bit with a lower pressure drop across the drilling motor. Since the torque developed for a given pressure is much greater than in the prior drilling motors, and since the capability of greater pressure differential across the motor is present, the combination of these factors results in the capability of the motor to generate a far greater torque than in the prior drilling motors.

By the way of example, since the torque generated at any pressure differential in this apparatus is about one and three-fourths times that developed by prior devices, the motor being operable at about twice the pressure differential of the prior device, the motor is capable of generating at least three and one-half times the torque of the prior devices. Accordingly, this apparatus has the capability of operating with about three and one-half times as much drilling weight imposed on the drill bit.

Furthermore, the motor can develop the proper horsepower while operating at much slower speeds than prior fluid motors, permitting roller-type drilling bits to be used without increased damage to their parts, so that the drilling bit is capable of drilling greater footages before requiring withdrawal from the borehole and replacement. The result is a considerable saving in drilling cost per foot of hole and a lesser number of drilling bits being required for drilling a required length of borehole. Moreover, there is substantial reduction in the time required for making round trips of the apparatus into and out of the borehole for the purpose of changing drilling bits.

The vibration of the rotor is considerably reduced by making it hollow, which reduces its mass, thereby contributing to long life of the motor and of the parts associated therewith. The vibration is also reduced by the ability to operate the drilling motor at reduced speeds.

Because of the use of a hollow rotor, with the advantages noted above, a dump valve assembly can be incorporated in the rotor itself, which is closed while drilling fluid is being pumped down through the drilling string and the drilling motor. The valve automatically opens to permit the drilling mud or other fluid to drain from the drill pipe, through the hollow rotor, motor shaft, and bit while the apparatus is being removed from a borehole filled with drilling mud or other fluid, the string of drill pipe automatically filling with the drilling mud or other fluid in the borehole while the drill pipe and apparatus are being run in the borehole.

The increased torque capabilities of the multiple lobe, hollow rotor fluid pressure motor naturally resulted in operators of well drilling equipment attempting to achieve even greater rates of penetration by applying excessive weight to the drilling bit, resulting in a slowing or stalling of rotation of the drilling bit, (creating a high-torque resistance to rotation of the rotor) and the development of a substantial pressure across the fluid pressure motor. In fact, when the fluid pressure motor stalls, the resulting high-fluid pressure tends to rapidly destroy the elastomeric components of the fluid pressure motor.

To overcome this problem, bypass and relief valve constructions have been developed which, in the event of a stall, bypasses the fluid pressure around the stalled motor and thus protects the motor from the effects of the excessive fluid pressure. Such control apparatus is shown, for example, in U.S. Pat. No. 4,275,795 to BEIMGRABEN et al.

While this control mechanism is effective to protect the elastomeric components of the fluid pressure operated motor from excessive fluid pressures produced by stalls, it does not meet the requirements of the operator for a pressure signal at the surface informing the operator that a stall has occurred. Some designers of fluid pressure operated motors have deliberately overdesigned the rotor and stator components to withstand the excessively high stall pressures, in order that the pressure surge accompanying a stalled motor would be indicated at the well surface to the well operator. In other words, the theory of such designs was that the motor would be more expensive, yet capable of withstanding the adverse pressure effects of stalling and giving the well operator immediate notice of the occurrence of a stall. However, it is noted that even with these designs the rotors and stators deteriorate at an accelerated rate when exposed to the high pressure needed for a signal.

It would obviously be desirable to utilize a less expensive design of fluid pressure motor and provide a control valve arrangement which would not only limit the fluid pressure applied to such motor in the event of a stall, but would also produce a substantially concurrent indication of the occurrence of a stall by causing a fluid pressure surge to be transmitted to the well surface to indicate to the well operator that a stall had occurred and that the amount of weight on the drill bit has to be decreased for drilling to resume.

SUMMARY OF THE INVENTION

The invention relates to a fluid pressure actuated bypass and relief valve which is positioned between a source of fluid under pressure and a fluid pressure operated device, such as a downhole well drilling motor. The valving apparatus is preferably mounted immediately above the fluid pressure motor which may be of the multiple spindle Moineau type illustrated and described in said U.S. Pat. No. 3,840,080. The valving apparatus comprises a tubular housing which is connected at its upper end to the bottom end of a tubular drill string through which pressure drilling fluid is supplied from a surface source.

The uppermost element of the valving apparatus comprises a valve slidably and sealably mounted in the housing sleeve. Such sleeve has a reduced diameter bore communicating with the larger diameter bore of the tubing string, thus producing a constriction in flow through such sleeve, hence creating of a downward force on the sleeve. The sleeve is spring biased to an upper position wherein external seals carried by the sleeve are disposed in non-bridging relationship to a plurality of radial ports extending through the tubular housing. In this manner, during run-in of the fluid pressure motor and the control apparatus, fluid in the well can readily enter the interior of the tubing string through the radial ports and the bore of the aforementioned sleeve valve. Conversely, during removal of the tubing string from the well, the well fluid can drain out of the tubing string through the same radial ports.

After run-in of the fluid pressure motor and the associated control apparatus to the lower portions of the well, the application of pressured well drilling fluid through the tubing string will effect a downward displacement of the sleeve valve and such valve will close off the radial ports and direct the fluid passing through the constricted bore of the sleeve valve downwardly toward the fluid pressure motor.

The pressured fluid then encounters an axially stationary flow diverter element which defines a plurality of peripherally spaced, axially directed flow passages for the pressured drilling fluid to direct the pressured drilling fluid downwardly as a generally annular stream. The central portion of the flow diverter element is hollow and a flow plug element is slidably and sealably mounted in the bore of the hollow diverter element. In its lower position, the axially shiftable flow plug is spaced downwardly from the bottom end of the bore of the sleeve valve so as to present no significant decrease in the flow path for the pressured fluid. In an upper position of the flow plug, the tapered end of the plug enters the bore of the sleeve valve and effects a substantial constriction in the flow path through such bore. Such constriction is sufficient to produce a fluid pressure signal at the surface of the well. As will be later described, the flow plug is shifted to its upper or second position upon the occurrence of a predetermined pressure increase across the fluid pressure motor corresponding to a point where net motor horsepower starts decreasing due to the motor approaching a stalled condition or a point limiting torque for better hole control which may be short of the motors peak horsepower.

The downwardly flowing annular stream of pressured fluid then flows around the outer periphery of a cylindrical cylinder housing within which a piston is slidably and sealably mounted. The piston has an upwardly projecting shaft portion extending axially out of the housing and into abutting engagement with the downwardly facing end of the flow plug so that upward movement of the piston effects the shifting of the flow plug to its second or upper position relative to the sleeve valve. The piston is normally biased to its lowermost position by one or more compression springs surrounding the piston shaft.

In the lowermost position of the piston, a downwardly projecting, annular extension portion of the piston cooperates with suitable seals to expose only the downwardly facing end of the annular piston extension to the pressure of the annular stream of pressured fluid, which contacts the piston through a plurality of peripherally spaced radial ports provided in the lower portions of the cylinder housing. Accordingly, when the fluid pressure of the annular stream of pressured drilling fluid increases to a predetermined level corresponding to the fluid pressure motor approaching a stalled condition, such fluid pressure, acting only on the limited area of the annular piston extension, will exert a sufficient upward force on the piston to overcome the bias of the compression springs and move the piston upwardly. The initial upward movement of the piston uncovers a seal which engages the internal surface of the annular axial piston extension and thereby exposes the entire downwardly facing area of the piston to the fluid pressure of the annular stream of pressure drilling fluid. It is thereby assured that the piston will positively move to its uppermost position in the cylinder housing and that such upward movement of the piston will concurrently produce an upward motion of the flow plug into the bore of the sleeve valve to substantially constrict the downward flow of the pressured drilling fluid. As stated, this produces a fluid pressure signal at the surface indicating to the well operator that the motor is approaching a stalled condition or is actually stalled.

The aforedescribed upward motion of the piston also opens a constricted annular flow path communicating the annular stream with the open bore of the hollow rotor of the fluid pressure motor, thus creating a flow path bypassing the fluid pressure motor and thereby immediately reducing the fluid pressure existing across such motor.

The constricted annular bypass flow path is defined by a conduit sealably mounted in a hollow bore portion of the piston and communicating with a plurality of peripherally spaced, radial ports provided in the shaft portion of the piston which communicate with the upwardly facing portions of the piston. Thus, a fluid pressure force acting downwardly on the piston is provided which is determined by the fluid pressure existing in the bypass flow path.

When the operator responds to the fluid pressure signal produced at the surface of the well by raising the drill string, the torque resistance to rotation of the rotor of the fluid pressure motor is substantially reduced, and the motor will commence rotation if stalled. In the event that the fluid pressure signal is generated prior to the rotor reaching the stall point, the rotor will substantially increase its operating speed and thus achieve a more efficient relationship between speed and torque to resume the drilling operation. In either event, the fluid pressure existing in the annular stream of the pressured drilling fluid surrounding the cylinder housing will be substantially reduced, hence reducing the upward fluid pressure force on the piston and permitting the compression springs, together with the downwardly directed fluid pressure force derived from the bypass flow path, to return the piston downwardly to its initial position in the cylinder housing wherein only the downwardly facing end surface of the annular axially extending piston portion is exposed to the pressured drilling fluid. Of course, downward movement of the piston inherently results in downward movement of the flow plug out of the constricted bore of the sleeve valve, hence permitting the entire fluid flow path for the drilling fluid to return to its normal condition.

It is therefore apparent that the method and apparatus of this invention, when applied to control of a fluid pressure motor for operating a drilling bit in a subterranean well, reacts to the occurrence of a predetermined fluid pressure across the fluid pressure motor, indicating that the motor is encountering excessive torque, to immediately effect a bypass of the pressured drilling fluid through the central bore of the hollow rotor of the fluid pressure motor, and concurrently effects a constriction in the bore of the sleeve valve to generate a fluid pressure signal which is detectable at the well surface by the well operator, permitting the well operator to immediately respond to such signal to take weight off the drilling bit and thus effect the reduction in the torque resistance encountered by the fluid pressure motor.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
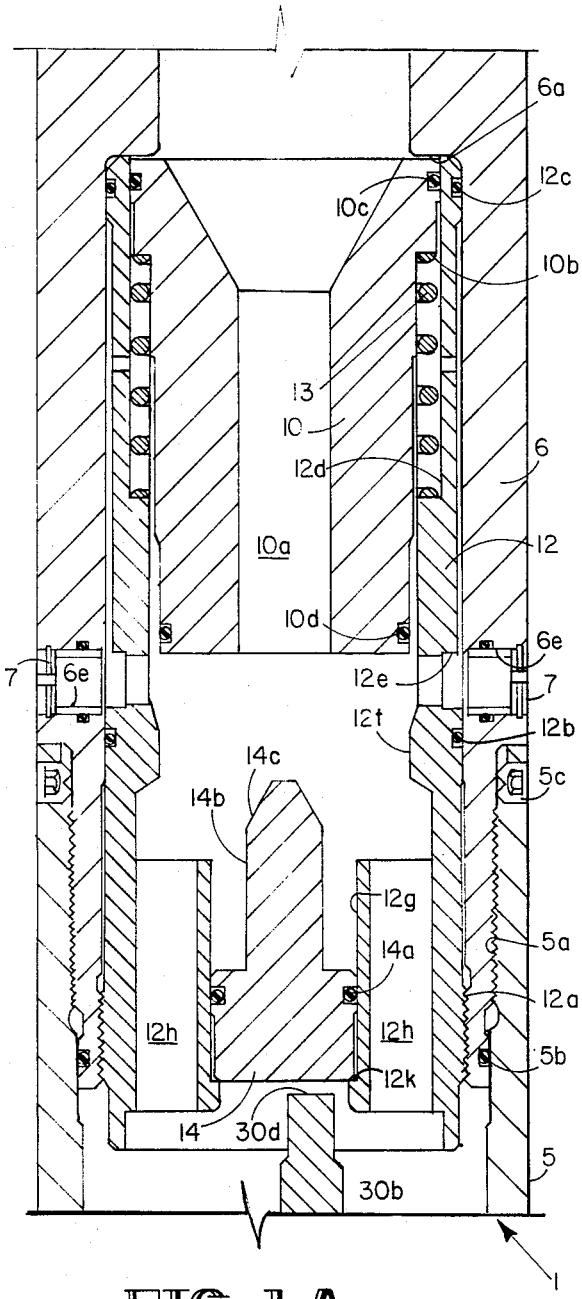
FIGS. 1A and 1B collectively represent a schematic vertical sectional view of a control apparatus embodying this invention shown in conjunction with a fluid pressure motor of the type employed for drilling subterranean wells, with the elements of the control apparatus shown in their run-in positions.
Figure 1B:
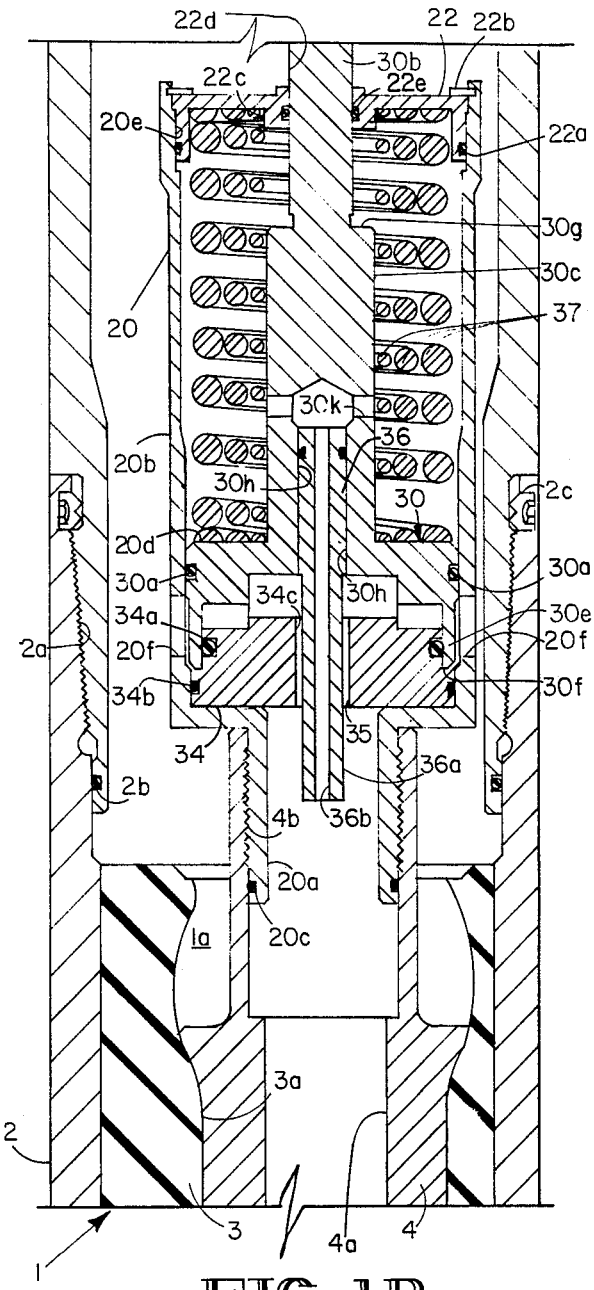

Referring to FIGS. 1A and 1B, a Moineau-type fluid pressure motor 1 is partially illustrated and comprises an outer tubular housing 2, an elastomeric stator 3, and a metallic rotor 4. Rotor 4 is provided with a plurality of helical vanes **4*a* cooperating with a plurality of helical grooves 3*a* formed in the elastomeric stator 3. As is typical in such motors, the stator has one lobe more than the rotor and, additionally, the rotor is eccentrically mounted relative to the stator 3 and the motor housing 2**. Further details of such motor may be found by reference to the aforementioned U.S. Pat. No. 3,840,080. The construction and operating characteristics of such motors are well-known to those skilled in the art.

Motor housing 2 is provided at its upper end with internal threads **2*a* which are engaged by corresponding external threads provided on the lower end of an intermediate housing 5. Threads 2*a* are sealed by an O-ring 2*b* and secured by a plurality of set screws 2*c*. The upper end of intermediate housing 5 is provided with internal threads 5*a* which are engaged with corresponding external threads provided on the bottom end of a top housing 6. Threads 5*a* are sealed by an O-ring 5*b* and secured by set screws 5*c*. The top end of upper housing 6 is provided with conventional connections to the bottom end of a drill string (not shown) by which fluid pressure may be supplied to the interior of the housing elements 6, 5 and 2 and thus to the annular entry chamber 1*a* defined between the stator 3 and the rotor 4 of the fluid pressure motor 1**.

Upper housing 6 is provided with an inwardly directed annular shoulder **6*a* which forms an upper seat for a sleeve valve 10 and a tubular intermediate housing 12. Housing 12 is secured to the lower end of the upper housing 6 by external threads 12*a* and these threads are sealed by O-ring 12*b*. The upper end of the intermediate housing 12 is sealed to the internal surface of the upper housing 6 by an O-ring 12*c***.

The intermediate tubular housing 12 is provided with a counter bore **12*d* in its upper end to cooperate with the exterior of the valve sleeve 10 to provide an annular space for the mounting of a compression spring 13. Compression spring 13 engages a downwardly facing peripheral shoulder 10*b* formed on the sleeve valve 10 and urges it to its upper position shown in FIG. 1A where it lies in abutment with the downwardly facing shoulder 6*a* defined by the upper housing 6**.

A seal **10*c* is provided on the outer periphery of the sleeve valve 10. Additionally, the central bore 10*a* of sleeve valve 10 is substantially reduced in diameter over the bore of the drill string through which pressured fluid is supplied to the fluid pressure operated motor 1. As a result, whenever pressured fluid is supplied through the drill string, a downward force is exerted on the sleeve valve 10**.

Adjacent the bottom end of the sleeve valve 10 when in its upper position, a plurality of peripherally spaced, aligned radial ports **12*e* and 6*e* are respectively provided in the inner tubular housing 12 and the upper housing 6. An apertured plug 7 is sealably inserted into each of the ports 6*e* so as to provide a controlled area opening in such ports. When the fluid pressure motor 1 and its accompanying drilling bit are lowered into the well, there is no fluid pressure force exerted on the sleeve valve 10 so it remains in its upper position shown in FIG. 1A. In this position, well fluids are free to move into the bore of the housing 6 through the ports 6e and fill the bore of the drill string (not shown) as the tool string is lowered into the well. Similarly, when the tool string is withdrawn from the well, the fluid contained in the drill string can drain out of the drill string through the apertured plugs 7**.

It is, of course, necessary that the fluid passageways through the apertured plugs 7 be closed once the tool string has been positioned in the well. This is automatically accomplished by the supplying of the pressured drilling fluid to the drill string by downward movement of the sleeve valve 10 produced by the drilling fluid. When sleeve valve 10 moves downwardly, an O-ring 10d carried on the bottom portions of the sleeve valve 10 engages an internally projecting seal bore 12f formed on the intermediate tubular housing 12 below the ports 12e and effects a seal therewith. Thus the ports 12e are effectively bridged by the O-rings 10c and 10d and the pressured drilling fluid flows past such ports to the fluid pressure motor 1.

Figure 2A:
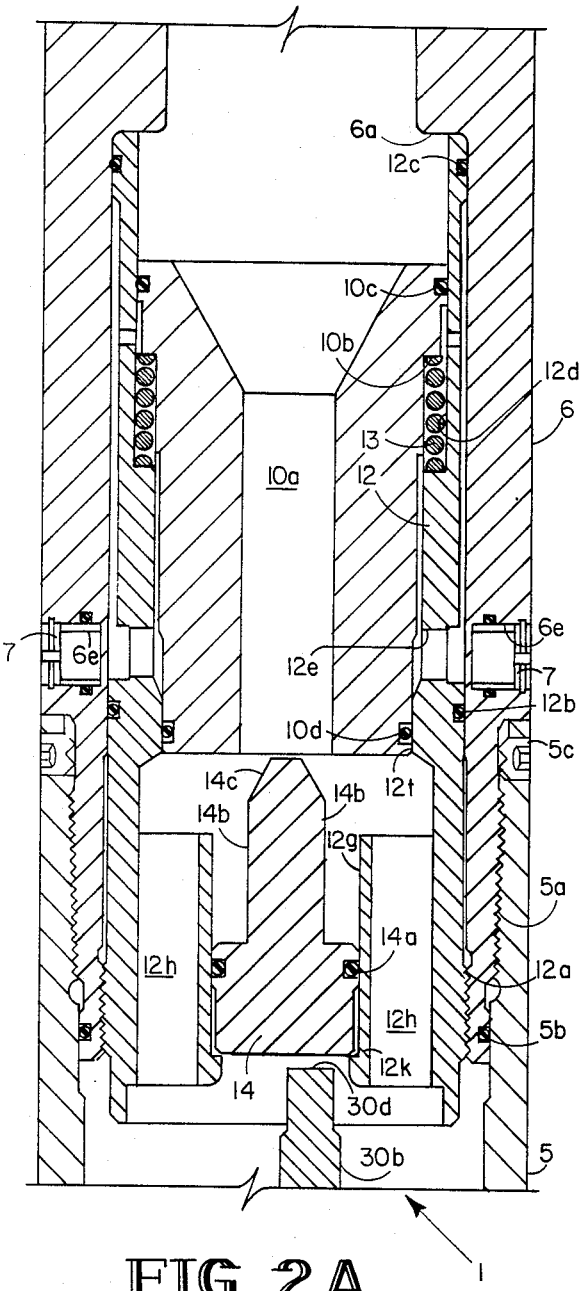
FIGS. 2A and 2B are views respectively similar to FIGS. 1A and 1B but showing the shifting of the sleeve valve in response to the initiation of flow of pressured fluid to the fluid pressure motor.
Figure 2B:
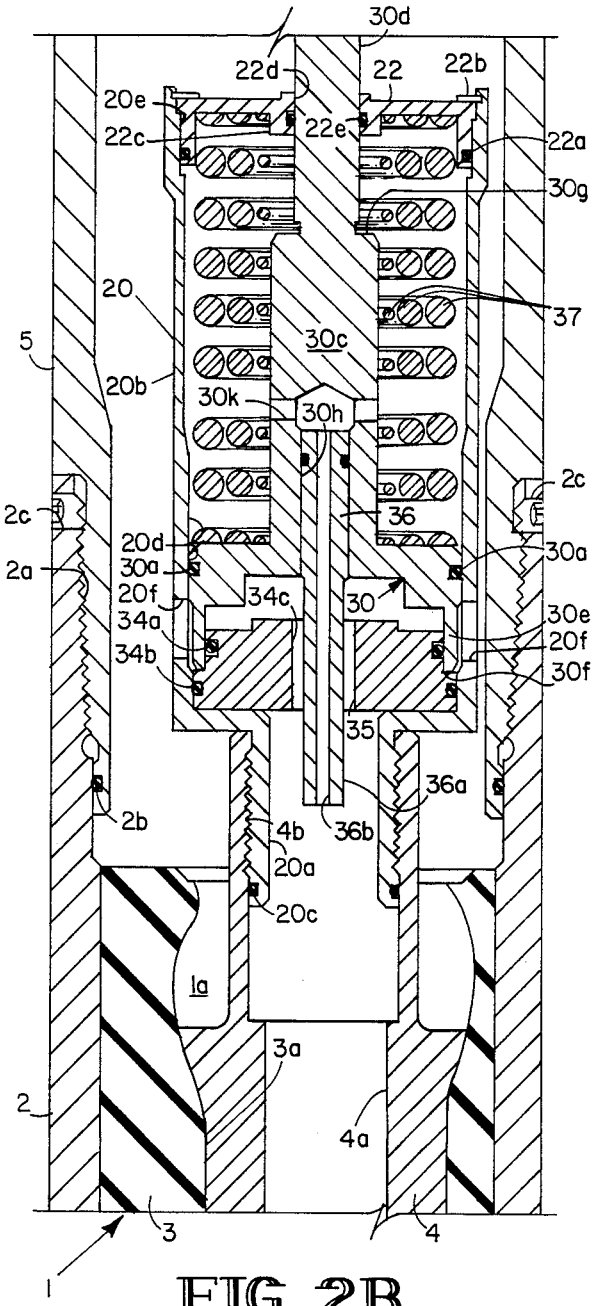

Reference should now be made to FIG. 2A which shows the position of the sleeve valve 10 when pressured drilling fluid is being supplied through the drill string to the fluid pressure motor 1. It will be noted that the lower portion of the inner tubular housing 12 defines a central bore 12g which in turn is surrounded by a plurality of peripherally spaced, axially extending fluid passages 12h. Thus, the pressured drilling fluid supplied through the bore 10a of the sleeve valve 10 is diverted into a substantially annular stream due to the fact that the bore 12g of the inner tubular housing 12 is sealingly blocked by a flow plug 14 which is slidably and sealably mounted within such bore by an O-ring 14a. In its lowermost position, the flow plug 14 abuts an internally projecting shoulder 12k formed in the bottom of the bore 12g of the inner tubular housing 12, as illustrated in FIG. 2A.

Figure 3A:
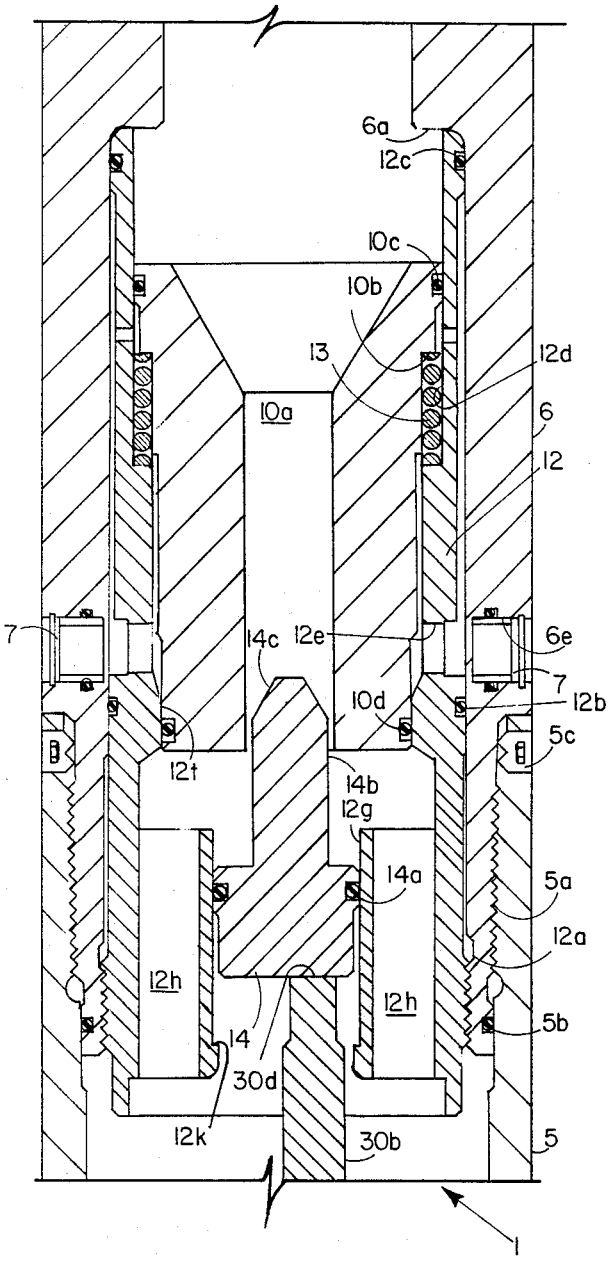
FIGS. 3A and 3B are views respectively similar to FIGS. 2A and 2B but illustrating the positions of the control apparatus elements assumed upon the occurrence of a predetermined pressure drop across the fluid pressure motor indicating that the motor is stalled or is approaching a stalled condition.

The flow plug 14 is provided with an upwardly extending cylindrical protuberance 14b which has a tapered end 14c. In its lower inoperative position shown in FIG. 2A, the end 14c of protuberance 14b is spaced axially away from the end of the bore 10a of the sleeve valve 10. However, if the plug 14a is moved from the position shown in FIG. 2A upwardly toward the sleeve valve 10, the protuberance 14b will enter the bore 10a of the sleeve valve 10 and thus effect a substantial constriction in the flow passage for the pressured drilling fluid. Such constriction will immediately produce a fluid pressure signal at the surface of the well which would be readily observable by the operator of the drilling rig. In accordance with this invention, the flow plug 14 is moved to its second operative position, as shown in FIG. 3A, in response to the development of a predetermined fluid pressure across the fluid pressure motor 1, hence in response to a predetermined increase in fluid pressure of the annular stream of pressured drilling fluid flowing downwardly to the fluid pressure motor 1.

A cylinder housing 20 is mounted in an axially fixed position below the bottom end of the inner tubular housing 12. In the preferred embodiment of this invention, the cylinder housing 20 has a reduced diameter bottom end portion 20a which is externally threaded to engage with internal threads 4b provided in an axial extension of the rotor 4 of the fluid pressure motor 1. The threads 4b are sealed by an O-ring 20c mounted in the lower portion 20a of the cylinder housing 20. Thus, the cylinder housing 20 is co-rotatable with the rotor 4 of the fluid pressure motor 1.

The upper portion 20b of the cylinder housing 20 is of substantially greater diameter and provides an internal bore surface 20d with which a piston 30 is slidably and sealably engaged as by O-ring 30a.

A bearing cap 22, which is of inverted cup-shaped configuration effects the sealing of the upper end of the cylinder housing 20. The side walls 22a of bearing cap 22 snugly engage the interior wall 20e of the cylinder housing 20 and an O-ring 22a seals such engagement. Bearing cap 22 is secured in position by a snap ring 22b which engages a suitable groove provided in the extreme upper portions of the cylinder housing 20.

The central portion 22c of the bearing cap 22 defines a bore 22d for slidably and sealably receiving a stem portion 30b of the piston 30 which is connected to the main piston body portion by an intermediate larger diameter shaft portion 30c. An O-ring 22e mounted in the bearing cap bore 22d effects the sealing of the sliding connection. As shown in FIGS. 1A and 2A, when the flow plug 14 is in its lowermost position, the top end 30d of the piston stem portion 30b is disposed immediately below the bottom surface of the flow plug 14. Hence, upward movement of the piston 30 will result in a corresponding upward movement of the flow plug 14.

As previously mentioned, the cylinder housing 20 is disposed within the annular stream of pressured drilling fluid created by the diverter portion of the inner tubular housing 12. During normal operation of the fluid pressure motor 1, such pressured fluid is in contact with only a small peripheral area portion of the piston 30. Such portion of the piston 30 is defined by a peripheral annular extension 30e which projects downwardly adjacent radial ports 20f formed in the cylinder housing 20. The contact of the annular pressured drilling fluid with only the downwardly facing end surface 30f of the axial annular extension 30e is caused by an annular plug 34 which is mounted within the bottom portions of the cylinder bore 20d of the cylinder housing 20 and mounts O-rings 34a and 30a respectively engaging the inner wall of the axial annular extension 30e and the cylinder bore wall 20d.

Figure 3B:
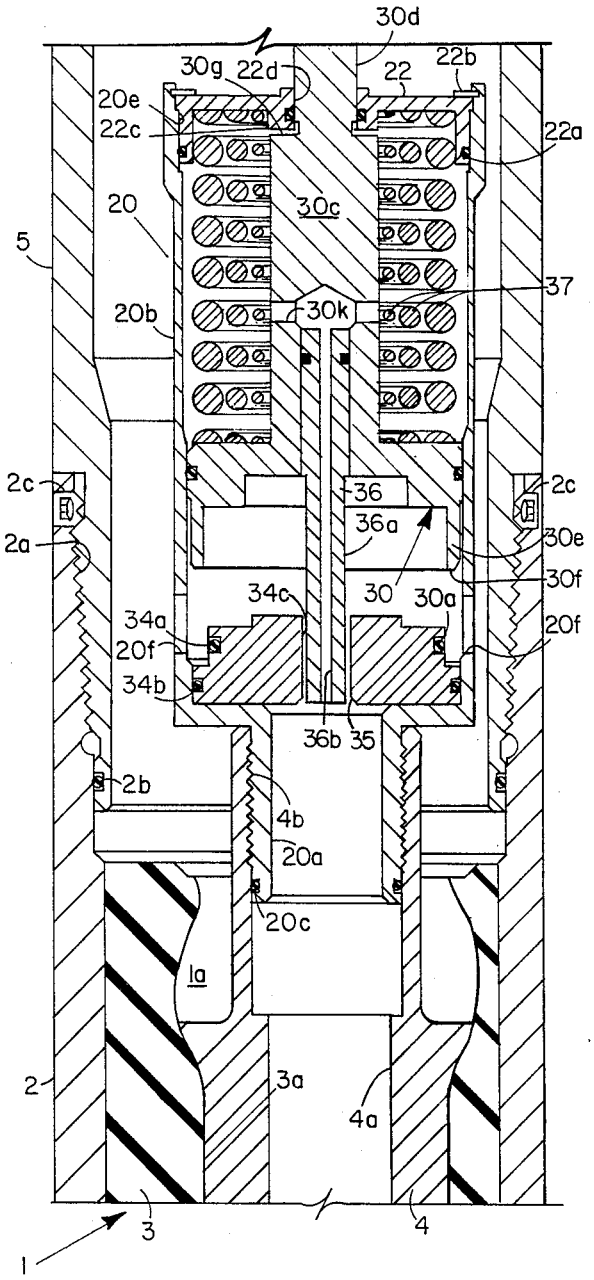

One or more compression springs 37 are mounted in the annular space between the shaft portion 30c of the piston 30 and the inner wall of the upper portion 20b of the cylinder housing 20. The force exerted by such springs is sufficient to maintain the piston in the position shown in FIGS. 1A and 2A, abutting plug 34, so long as the fluid pressure of the annular stream of pressured drilling fluid remains below a predetermined value. Upon the fluid pressure reaching a predetermined value, which can correspond to the stall point of the motor, or preferably a fluid pressure which precedes the actual stalling of the fluid pressure motor 1, the piston 30 will be moved upwardly by such fluid pressure force acting on the downwardly facing limited area portion 30f. Once the piston 30 moves upwardly a sufficient distance so that the annular axial extension 30e clears the O-ring 34a, then the entire bottom surface of the piston 30 is exposed to the pressure of the annular fluid pressure stream and the piston is moved rapidly to its uppermost position wherein the shoulder 30g at the juncture 30b and shaft portions 30c contacts the central bearing portion 22c of the bearing cap 22, as shown in FIG. 3B. It is thereby assured that the piston 30 will not flutter but will either move all the way to its upper position or remain in its lower position.

The upward movement of the piston 30 effects a corresponding upward displacement of the flow plug 14 causing the tapered top end 14c of the flow plug to enter the bore 10a of the sleeve valve 10 and thus effect a substantial constriction of the flow passage for the pressured drilling fluid being supplied from the well surface. Such constriction will immediately produce a fluid pressure signal which will indicate to the operator that the predetermined fluid pressure across the fluid pressure motor has been reached and that the set down weight on the drilling bit should be diminished to prevent stalling of the motor 1 or to initiate the restart of the motor 1, if stalling has already occured.

The upward movement of the piston 30 performs a second function designed expressly to prevent the maintenance of a high fluid pressure across the rotor and the stator elements of the fluid pressure motor 1, which inherently results in damage to such elements, particularly to the elastomeric stator element 3. As previously mentioned, the piston plug 34 is of annular configuration and defines a central bore 34c. Piston 30 defines a bore 30h in alignment with the piston plug bore 34c. A pipe 36 is press fitted, or otherwise suitably sealably secured within the piston bore 30h and has a reduced diameter portion 36a extending through the bore 34c and defining an annular passageway 35 therebetween. Such annular passageway constitutes a bypass flow path for the fluid pressure motor 1 extending from the annular fluid pressure stream through the cylinder housing ports 20f downwardly through the annular passage 35 and into the central bore 4a of the hollow rotor 4 of the fluid pressure motor 1. This bypass flow passage inherently effects an immediate reduction in the fluid pressure existing across the rotor and stator of the fluid pressure motor, thus protecting such elements from damage by excessive fluid pressure. However, some pressure is maintained by the remaining restriction through passageway 35.

Additionally, the bore 36b of pipe 36 provides communication between the fluid pressure existing in the bypass flow path and the upwardly facing portions of the piston 30. The upper end of the bore 36b is in fluid communication with a plurality of peripherally spaced radial ports 30k formed in the shaft portion 30c of the piston 30, and hence in communication with the upwardly facing portions of the piston 30 disposed in the cylinder housing 20. The pressure maintained by the passageway 35 exerted on the upwardly facing portions or piston 30 keeps the spring or springs 37 compressed and the flow plug 14 in place.

The operation of the aforedescribed apparatus is believed to be apparent from the previous description. Obviously, the piston 30 will move rapidly to its uppermost position upon the occurrence of a predetermined fluid pressure in the annular stream of pressured drilling fluid supplied to the fluid pressure motor 1. Upon such movement of the piston, a substantial constriction in the flow path for the pressured drilling fluid is established by the flow plug 14 entering the bore 10a of the sleeve valve 10. Concurrently, a constricted bypass flow path is produced through the cylinder housing ports 20f and the hollow bore 4a of the rotor 4 by virtue of the annular passageway 35.

The fact that the fluid pressure existing in the bypass flow path is applied to the upwardly facing surfaces of the piston 30 is further assurance that the piston 30 will return to its initial or downward position promptly upon the reduction of the fluid pressure in the annular stream of pressured drilling fluid to a level below the predetermined undesirable level. The piston moves downwardly under the bias of both the compression springs 37 and the fluid pressure existing in the bypass flow path, whenever the fluid pressure existing in the annular stream of pressured drilling fluid falls a significant level below the predetermined pressure level which caused the piston to move upwardly.

Obviously, the selection of the predetermined pressure level at a value short of the pressure developed when the fluid pressure motor 1 is stalled is quite desirable in that it can be assured that the fluid pressure motor 1 will always be operating in a high efficiency range which is characterized by high torque, but concurrently, a relatively high rotational speed. The total horsepower consumed in the drilling operation is a measure of its efficiency and the aforedescribed method and apparatus will assure the operation of the drilling motor in a high efficiency range so long as the operator is observant of the fluid pressure signals generated at the surface by the flow constriction production by the upward movement of the piston 30.

It is apparent that the method and apparatus of this invention can be employed to protect other types of fluid pressure actuated devices than drilling motors. Whenever it is desired to limit the fluid pressure applied across a fluid pressure operated device to a predetermined value and concurrently provide an indication at the surface when the pressure reaches such predetermined value, the method and apparatus of this invention will function very satisfactorily. Accordingly, the term "fluid pressure motor" employed in the claims should be broadly construed as including any type of fluid pressure operated device.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Fluid pressure control apparatus for a fluid pressure operated motor positioned downhole in a subterranean well, comprising, in combination; conduit means for conducting pressured fluid from the surface; sleeve means for receiving the pressured fluid; diverter means positioned below said sleeve means for directing the fluid flow downwardly in an annular stream; an axially shiftable plug mounted in said diverter means; said plug having a normal position axially spaced from said sleeve means and an operative position axially inserted in said sleeve to substantially constrict the fluid flow passage through said sleeve means and thereby produce a significant pressure increase of said pressure fluid observable at the well surface; and actuator means disposed between said plug and the fluid pressure operated motor for shifting said plug to said operative position in response to a predetermined fluid pressure buildup across said fluid pressure operated motor, thereby preventing excessive fluid pressures being applied to said fluid pressure operated motor and providing a surface indication that the fluid pressure motor is approaching a predetermined torque limit.

2. The apparatus of claim 1 wherein said actuator means includes a piston means shiftable by said predetermined fluid pressure buildup to divert a portion of the pressured fluid applied to the fluid pressure operated motor around the fluid pressure operated motor to further reduce the fluid pressure applied to the fluid pressure operated motor.

3. In combination with a fluid pressure operated well-drilling motor of the type having a hollow rotor with external helical splines cooperating with internal helical grooves in a stator; control apparatus for supplying pressured fluid between said rotor and stator to drive said fluid pressure operated motor comprising: a sleeve; means for supplying pressured fluid to said fluid pressure operated motor through the bore of said sleeve; axially shiftable plug means mounted intermediate said sleeve and said fluid pressure operated motor, said plug means having a remote position relative to the bore of said sleeve and a proximate position restricting flow of pressured fluid through said sleeve to produce a fluid pressure signal upstream of said sleeve; said axially shiftable plug means being normally urged by the pressured fluid to said remote position; and piston means responsive to a predetermined increase in fluid pressure applied to said fluid pressure operated motor to axially shift said plug means to said proximate position.

4. The apparatus defined in claim 3 further comprising valve means operable by said piston means for diverting a portion of the pressured fluid applied to said fluid pressure operated motor through the bore of said hollow rotor, thereby further reducing the fluid pressure differential across said fluid pressure operated motor.

5. Fluid pressure control apparatus for a fluid pressure motor positioned downhole in a subterranean well, comprising, in combination; conduit means for conducting pressured fluid from the surface; sleeve means for receiving the pressure fluid; flow diverter means positioned below said sleeve means for directing pressured fluid flow downwardly in an annular stream for application to the fluid pressure operated motor; a cylinder housing positioned within said annular stream; an axially shiftable piston mounted in said cylinder housing; a flow plug in said diverter means operatively connected to the upstream end of said piston; said piston having a first position in said cylinder housing wherein said flow plug is axially spaced from said sleeve means and a second position wherein said flow plug is at least partially inserted in the bore of said sleeve means to substantially constrict the fluid flow through said sleeve means and thereby produce a significant pressure increase of said pressured fluid observable at the well surface; resilient means urging said piston to said first position; means for exposing a portion of said piston to said annular fluid stream, whereby an increase in fluid pressure across said fluid pressure motor to a predetermined level effects the shifting of said piston to said second position; and valve means operable by said movement of said piston to said second position to open a flow path bypassing said fluid pressure motor and thereby reduce the fluid pressure applied to drive said fluid pressure motor.

6. The apparatus of claim 5 wherein the fluid pressure motor includes a hollow rotor cooperable with a fixed stator and said flow path includes the bore of said hollow rotor.

7. The apparatus of a claim 5 wherein said portion of said piston exposed to said annular fluid stream comprises a peripheral axial extension on the downstream radial end face of said piston; and said means for exposing only said portion of said piston to said annular fluid stream comprises a hollow cylindrical plug slidably and sealably engaged with the bore of said peripheral axial extension when said piston is in said first position and disengaged by said peripheral axial extension as said piston moves to said second position, whereby the effective area of said piston exposed to said annular fluid stream is substantially increased.

8. The apparatus of claim 7 wherein the fluid pressure motor includes a hollow rotor cooperable with a fixed stator and said flow path includes the bore of said hollow rotor.

9. The apparatus of claim 8 wherein the bore of said cylindrical plug communicates with the bore of said hollow rotor to reduce the flow of pressured fluid between said rotor and stator of said fluid pressure motor.

10. The apparatus of claim 5 wherein said cylinder housing and said piston are co-rotatable with the fluid pressure motor.

11. The apparatus of claim 7 wherein said cylinder housing, said piston and said hollow cylindrical plug are co-rotatable with the fluid pressure motor.

12. The apparatus of claim 5 further comprising a pressure sensing conduit sealingly mounted in said piston and having a bore communicating the upstream facing portions of said piston within said cylinder housing with said flow path, whereby a downward fluid pressure force proportional to the fluid pressure in said flow path is applied to said piston.

13. The apparatus of claim 7 further comprising a tubular conduit sealingly mounted in said piston and having a bore communicating the upstream facing portions of said piston within said diverter housing with said flow path, whereby a downward fluid pressure force proportional to the fluid pressure in said flow path is applied to said piston.

14. The apparatus of claim 13 wherein the periphery of said conduit cooperates with the bore of said hollow cylindrical plug to define an annular orifice in said flow path, thereby reducing the fluid pressure of fluid passing through said flow path below the fluid pressure in said annular stream and effecting the return of said piston to said first position upon a predetermined reduction in fluid pressure across the fluid pressure motor.

15. The method of protecting a fluid pressure motor located downhole in a subterranean well from high fluid pressures produced by undesirably high torque resistance to rotation of the fluid pressure motor, comprising the steps of: diverting a portion of the pressured fluid around the fluid pressure motor in response to a predetermined increase in fluid pressure across the fluid pressure motor; and substantially concurrently producing a substantial reduction in flow area for the pressured fluid upstream of the fluid pressure motor in response to said predetermined increase in fluid pressure across the fluid pressure motor, thereby producing an indication at the well surface of said high torque resistance.

16. The method of protecting a fluid pressure motor located downhole in a subterranean well from high fluid pressures produced by undesirably high torque resistance to rotation of the fluid pressure motor comprising the steps of: supplying pressured fluid from the surface to the fluid pressure motor; shifting a spring opposed piston in response to a predetermined increase in fluid pressure across the fluid pressure motor; diverting a portion of the pressured fluid around the fluid pressure motor in response to said shifting of the spring opposed piston; and substantially concurrently producing a substantial reduction in flow area for the pressured fluid upstream of the fluid pressure motor in response to said shifting of the spring opposed piston, thereby producing an indication at the well surface of said high torque resistance.

17. Fluid pressure control apparatus for a fluid responsive element, comprising, in combination; conduit means for conducting pressured fluid from an initial source; sleeve means for receiving the pressured fluid; diverter means positioned below said sleeve means for directing the fluid flow downwardly in an annular stream; an axially shiftable plug mounted in said diverter means; said plug having a normal position axially spaced from said sleeve means and an operative position axially inserted in said sleeve to substantially constrict the fluid flow passage through said sleeve means and thereby produce a significant pressure increase of said pressure fluid; an actuator means disposed between said plug and the fluid responsive element for shifting said plug to said operative position in response to a predetermined fluid pressure buildup across said fluid responsive element, thereby preventing excessive fluid pressures being applied to said fluid responsive element and providing an indication that the fluid responsive element is approaching a predetermined torque limit.

18. The apparatus of claim 17 wherein said actuator means includes a piston means shiftable by said predetermined fluid pressure buildup to divert a portion of the pressured fluid applied to the fluid responsive element around the fluid responsive element to further reduce the fluid pressure applied to the fluid responsive element.

19. Fluid pressure control apparatus for a fluid responsive element, comprising, in combination; conduit means for conducting pressured fluid from an initial source; sleeve means for receiving the pressured fluid; diverter means positioned below said sleeve means for directing the fluid flow downwardly in an annular stream; an axially shiftable plug mounted in said diverter means; said plug having a normal position axially spaced from said sleeve means and an operative position axially inserted in said sleeve to substantially constrict the fluid flow passage through said sleeve means and thereby produce a significant pressure increase of said pressure fluid; an actuator means disposed between said plug and the fluid responsive element for shifting said plug to said operative position in response to a predetermined fluid pressure buildup across said fluid responsive element, thereby preventing excessive fluid pressures being applied to said fluid responsive element and providing an indication that the fluid responsive element is approaching a predetermined value.

20. The apparatus of claim 19 wherein said actuator means includes a piston means shiftable by said predetermined fluid pressure buildup to divert a portion of the pressured fluid applied to the fluid responsive element around the fluid responsive element to further reduce the fluid pressure applied to the fluid responsive element.

21. Fluid pressure control apparatus for a fluid responsive element, comprising, in combination; first means for conducting pressured fluid from a source; second means for receiving the pressured fluid; diverter means positioned adjacent said second means for directing the fluid flow in one direction and in an annular stream; an axially shiftable plug mounted immediately said diverter means; said plug having a first position axially spaced from said second means and a second position axially insertable in said second means to substantially constrict the fluid flow passage through said second means and thereby produce a significant pressure variant of said pressure fluid; an actuator means disposed between said plug and the fluid responsive element for shifting said plug to said operative position in response to a predetermined fluid pressure variant within said fluid responsive element, thereby preventing excessive fluid pressures being applied to said fluid pressure element and providing an indicator that the fluid pressure responsive element is approaching a predetermined value of motion.

* * * * *